US007972189B2

(12) United States Patent
Urano

(10) Patent No.: US 7,972,189 B2
(45) Date of Patent: Jul. 5, 2011

(54) TILT AND TRIM DEVICE FOR OUTBOARD MOTOR

(75) Inventor: Masaki Urano, Shizuoka (JP)

(73) Assignee: Yamaha Motor Hydraulic System Co., Ltd., Shizuoka (JP)

( * ) Notice: Subject to any disclaimer, the term of this patent is extended or adjusted under 35 U.S.C. 154(b) by 181 days.

(21) Appl. No.: 12/394,196

(22) Filed: Feb. 27, 2009

(65) Prior Publication Data

US 2009/0221197 A1 Sep. 3, 2009

(30) Foreign Application Priority Data

Feb. 29, 2008 (JP) ..... 2008-050728

(51) Int. Cl.
*B63H 5/125* (2006.01)
*B63H 20/08* (2006.01)

(52) U.S. Cl. ..... 440/61 G

(58) Field of Classification Search ..... 440/61 T, 440/61 D, 61 E, 61 F, 61 G, 61 H, 61 J, 61 R, 440/52, 49
See application file for complete search history.

(56) References Cited

U.S. PATENT DOCUMENTS 3,999,502 A * 12/1976 Mayer ..... 440/52
6,682,376 B2 * 1/2004 Saito ..... 440/61 D
6,948,988 B2 * 9/2005 Okabe ..... 440/61 R
2002/0146945 A1 10/2002 Saito

FOREIGN PATENT DOCUMENTS

JP 2002-308184 A 10/2002

* cited by examiner

*Primary Examiner* — Daniel V Venne
(74) *Attorney, Agent, or Firm* — Keating & Bennett, LLP

(57) ABSTRACT

A tilt and trim device for an outboard motor includes a tilt cylinder and a trim cylinder arranged to raise and lower the outboard motor, a reserve tank, an oil route arranged to allow the tilt cylinder to communicate with the reserve tank, and a branch oil route branched from the oil route and arranged to communicate with the trim cylinder. At least one hydraulic pressure adjustment mechanism is arranged to adjust the hydraulic pressure applied to the trim cylinder via the branch oil route to be equal to or lower than a pressure resistance of the trim cylinder when the outboard motor is forcibly lowered by an external force from a tilt range in which the outboard motor is raised or lowered only by the tilt cylinder. The tilt and trim device is operative to prevent deformation of and damage to a trim cylinder by suppressing the hydraulic pressure applied to the trim cylinder to be not greater than a specified pressure value even when the outboard motor is rapidly lowered from a tilt range, and a high hydraulic pressure from the tilt cylinder is returned in the direction of the trim cylinder.

6 Claims, 14 Drawing Sheets

Hydraulic circuit diagram

Hydraulic circuit diagram

Hydraulic circuit diagram

Hydraulic circuit diagram

Hydraulic circuit diagram

Hydraulic circuit diagram

TILT AND TRIM DEVICE FOR OUTBOARD MOTOR

BACKGROUND OF THE INVENTION

1. Field of the Invention

The present invention relates to a trim and tilt device for an outboard motor, and more specifically, relates to a configuration for adjusting the hydraulic pressure in the trim and tilt device.

2. Description of the Related Art

An outboard motor in a boat and the like is mounted on a stern via a tilt and trim device capable of adjusting a mounting angle of the outboard motor to a hull. This tilt and trim device includes a device body including a molded portion, a tilt cylinder, a trim cylinder, and a hydraulic pressure pump which are mounted on the device body. A hydraulic route for allowing the outlet side of the hydraulic pressure pump to communicate with the tilt cylinder and the trim cylinder is provided in the device body.

The tilt cylinder is rotatably mounted via a clamp shaft to a clamp bracket fixed to the stern. For example, two trim cylinders are arranged to have the tilt cylinder therebetween. In a trim range, a piston rod is raised since a piston in the trim cylinder is pushed up, and the piston rod contacts a tilt bracket mounted on the clamp bracket. This allows the outboard motor to be raised in the trim range. The tilt bracket is supported by the clamp bracket to pivot about a horizontal shaft. The outboard motor is supported by the tilt bracket.

Generally, this kind of boat travels such that the outboard motor can be raised or lowered using the trim cylinder, that is, in a trim range. During acceleration of the boat, the outboard motor travels in a raised (pivoted) state within the trim range. When the boat travels in shallow water, the outboard motor is raised to a tilt range in order to prevent the propeller from contacting the bottom. After passing through shallow water, an operator lowers the outboard motor to the trim range to travel again under normal conditions.

This kind of tilt and trim device for an outboard motor is disclosed in JP-A-2002-308184. This tilt and trim device can be used for the tilt operation and the trim operation of the outboard motor, and the boat can travel under normal conditions.

However, after passing through shallow water, some operators fully open an accelerator before the outboard motor is lowered to the trim range. This causes the outboard motor to be lowered while a propeller rotates under maximum output power. When the propeller is lowered to the water surface in such a state, the propeller churns water suddenly, and thrust under maximum output power of an engine is generated. At the same time, a reaction force of the thrust acts on the outboard motor and attempts to rapidly lower the outboard motor.

At a position in the tilt range when the propeller is lowered to the water surface, a load of the outboard motor and the reaction force are received only by the tilt cylinder. When the outboard motor is rapidly lowered from that position, hydraulic pressure in the tilt cylinder flows into the trim cylinder and the reserve tank that communicates with the tilt cylinder. The hydraulic pressure at this time is high, so that it is necessary to suppress the inner pressure of the trim cylinder with a relatively low pressure resistance to not greater than a specified pressure.

Generally, in a state in which the piston rod of the trim cylinder contacts the tilt bracket, the trim cylinder can sufficiently withstand the high hydraulic pressure caused by the reaction force of the thrust of the propeller even when the accelerator is fully opened since the high hydraulic pressure is received by a piston supported by the tilt bracket via the piston rod. However, in a case that the trim cylinder receives the reaction force of the thrust of the propeller under a fully-opened state of the accelerator before the piston rod of the trim cylinder contacts the tilt bracket as described above, as a piston in the trim cylinder is unsupported, the pressure generated in the tilt cylinder is rapidly transmitted to the trim cylinder so that the rapid pressure increase occurs.

In order to avoid this, it is conceivable to increase the pressure resistance by thickening the trim cylinder. However, the width of the exiting tilt and trim device is predetermined. Consequently, the size of the trim cylinder is limited, and it is difficult to increase the pressure resistance by changing the size of the trim cylinder itself. Moreover, thickening of the trim cylinder is not preferable since it goes against the recent development of a lightweight tilt and trim device.

SUMMARY OF THE INVENTION

In order to overcome the problems described above, preferred embodiments of the present invention provide a tilt and trim device for an outboard motor that prevents deformation of and damage to a trim cylinder by suppressing the hydraulic pressure applied to the trim cylinder to be not greater than a specified pressure even when an outboard motor is rapidly lowered from a tilt range and a high hydraulic pressure from a tilt cylinder is returned in the direction of the trim cylinder.

According to a first preferred embodiment of the present invention, a tilt and trim device for an outboard motor includes a tilt cylinder arranged to raise and lower the outboard motor, a trim cylinder arranged to raise and lower the outboard motor, a tilt cylinder extension side oil chamber provided in the tilt cylinder, a trim cylinder extension side oil chamber provided in the trim cylinder, a reserve tank arranged to receive a difference of an oil amount between an oil amount corresponding to a rod included in the tilt cylinder and an oil amount corresponding to a rod included in the trim cylinder when the outboard motor is operated, a relief valve arranged to communicate with the reserve tank, an oil route arranged to allow the tilt cylinder extension side oil chamber to communicate with the reserve tank, and a branch oil route branched from the oil route to communicate with the trim cylinder, wherein at least one hydraulic pressure adjustment mechanism is arranged between the tilt cylinder extension side oil chamber and the trim cylinder extension side oil chamber to adjust hydraulic pressure applied to the trim cylinder via the branch oil route to be not greater than a specified value when the outboard motor is forcibly lowered by external force from a tilt range in which the outboard motor is raised or lowered only by the tilt cylinder.

According to a second preferred embodiment of the present invention, the hydraulic pressure adjustment mechanism includes an orifice portion provided in the oil route or the branch oil route that allows the tilt cylinder extension side oil chamber to communicate with the trim cylinder extension side oil chamber.

According to a third preferred embodiment of the present invention, an inner diameter of the orifice portion is not greater than an inner diameter of the oil route.

A fourth preferred embodiment of the present invention includes a through hole penetrating a piston in the trim cylinder in the sliding direction of the piston and a one-way relief valve arranged to allow oil to flow from the trim cylinder extension side oil chamber.

A fifth preferred embodiment of the present invention includes a free piston provided in the tilt cylinder and a one-way relief valve provided in the free piston arranged to allow oil to flow from the tilt cylinder extension side oil chamber.

A sixth preferred embodiment of the present invention includes a bypass route arranged to connect the branch oil route and the reserve tank, and a one-way relief valve arranged to allow oil to flow in the direction of the reserve tank of the bypass route.

According to the first preferred embodiment, the hydraulic pressure adjustment mechanism arranged to allow the hydraulic pressure applied to the trim cylinder via the branch oil route to be not greater than a specified value (more specifically, the pressure resistance value of the trim cylinder) is preferably provided. As a result, the hydraulic pressure not smaller than the pressure resistance of the trim cylinder is not applied to the trim cylinder even when the outboard motor is rapidly lowered from the tilt range in which the piston rod of the trim cylinder does not contact the tilt bracket. Consequently, the deformation of and damage to the trim cylinder can be reliably prevented.

According to the second preferred embodiment, the hydraulic pressure adjustment mechanism preferably includes the orifice portion in the oil route or the branch oil route which is an oil route from the tilt cylinder to the trim cylinder. As a result, the oil is prevented from flowing in the trim cylinder direction, which prevents the application of excessive hydraulic pressure to the trim cylinder. Moreover, by providing the orifice portion in the branch oil route, the hydraulic pressure applied to the trim cylinder can be reduced without influencing the oil flow in the oil route in the normal raising or lowering operation of the outboard motor by a hydraulic pump.

According to the third preferred embodiment, an inner diameter of the orifice portion preferably is not greater than about half of an inner diameter of the oil route. Such an inner diameter sufficiently inhibits the hydraulic pressure applied to the trim cylinder so that the deformation of and damage to the trim cylinder can be prevented. Moreover, in a case that the inner diameter of the orifice portion is about half of the inner diameter of the oil route (for example, the oil route is about $\phi$3 mm when the orifice portion is about $\phi$1.5 mm), the oil flow in the normal raising or lowering operation of the outboard motor by the hydraulic pump is not influenced even when the orifice portion is provided in the oil route.

According to the fourth preferred embodiment, the through hole penetrates the piston in the trim cylinder in the sliding direction of the piston, and the one-way relief valve arranged to allow the oil to flow in the through hole from the rear side of the piston in the trim cylinder (the side of the trim cylinder extension side oil chamber) are provided. As a result, even when the outboard motor is rapidly lowered from the tilt range, and the high hydraulic pressure not smaller than the pressure resistance of the trim cylinder is applied to an inner portion of the trim cylinder, the one-way relief valve provided in the through hole is opened to release the hydraulic pressure in the direction of the rod of the trim cylinder. This reduces the hydraulic pressure applied to the trim cylinder so that the deformation of and damage to the trim cylinder that can be caused by excessive hydraulic pressure can be prevented.

According to the fifth preferred embodiment, the free piston provided in the tilt cylinder, and the one-way relief valve provided in the free piston arranged to allow oil to flow from the tilt cylinder extension side oil chamber are provided. As a result, the one-way relief valve is opened to release the hydraulic pressure in the direction of the rod of the tilt cylinder when the outboard motor is forcibly lowered from the tilt range by external force. By utilizing this configuration with the orifice portion, the pressure applied to the trim cylinder can be reduced more effectively. In particular, this configuration is utilized effectively with the orifice portion when an aperture of the orifice portion is not smaller than about half of the inner diameter of the oil route or when it is difficult to reduce the high pressure from the tilt cylinder extension side oil chamber only by the orifice portion and the like.

According to the sixth preferred embodiment, the bypass route that connects the branch oil route and the reserve tank, and the one-way relief valve arranged to allow the oil to flow in the direction of the reserve tank of the bypass route are provided. Due to this, the one-way relief valve is opened to release the hydraulic pressure to the reserve tank when the outboard motor is forcibly lowered from the tilt range by external force. By utilizing this configuration with the orifice portion, the pressure applied to the trim cylinder can be reduced more effectively. In particular, this configuration is utilized effectively with the orifice portion when the aperture of the orifice portion is not smaller than about half of the inner diameter of the oil route or when it is difficult to reduce the high pressure from the tilt cylinder extension side oil chamber only by the orifice portion and the like.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

A preferred embodiment of the present invention is directed to a tilt and trim device for an outboard motor including a tilt cylinder arranged to raise and lower the outboard motor, a trim cylinder arranged to raise and lower the outboard motor, a tilt cylinder extension side oil chamber provided in the tilt cylinder, a trim cylinder extension side oil chamber provided in the trim cylinder, a reserve tank arranged to receive the difference of an oil amount corresponding to a rod included in the tilt cylinder and the trim cylinder when the outboard motor is operated, a relief valve arranged to communicate with the reserve tank, an oil route arranged to allow the tilt cylinder extension side oil chamber to communicate with the reserve tank, and a branch oil route branched from the oil route and arranged to communicate with the trim cylinder, wherein at least one hydraulic pressure adjustment mechanism is arranged between the tilt cylinder extension side oil chamber and the trim cylinder extension side oil chamber to adjust the hydraulic pressure applied to the trim cylinder via the branch oil route to be equal to or lower than a specified value when the outboard motor is forcibly lowered by external force from a tilt range in which the outboard motor is raised or lowered only by the tilt cylinder.

Initially, a description will be made of the configuration of a tilt and trim device for an outboard motor to which preferred embodiments of the present invention is applied.

Figure 1:
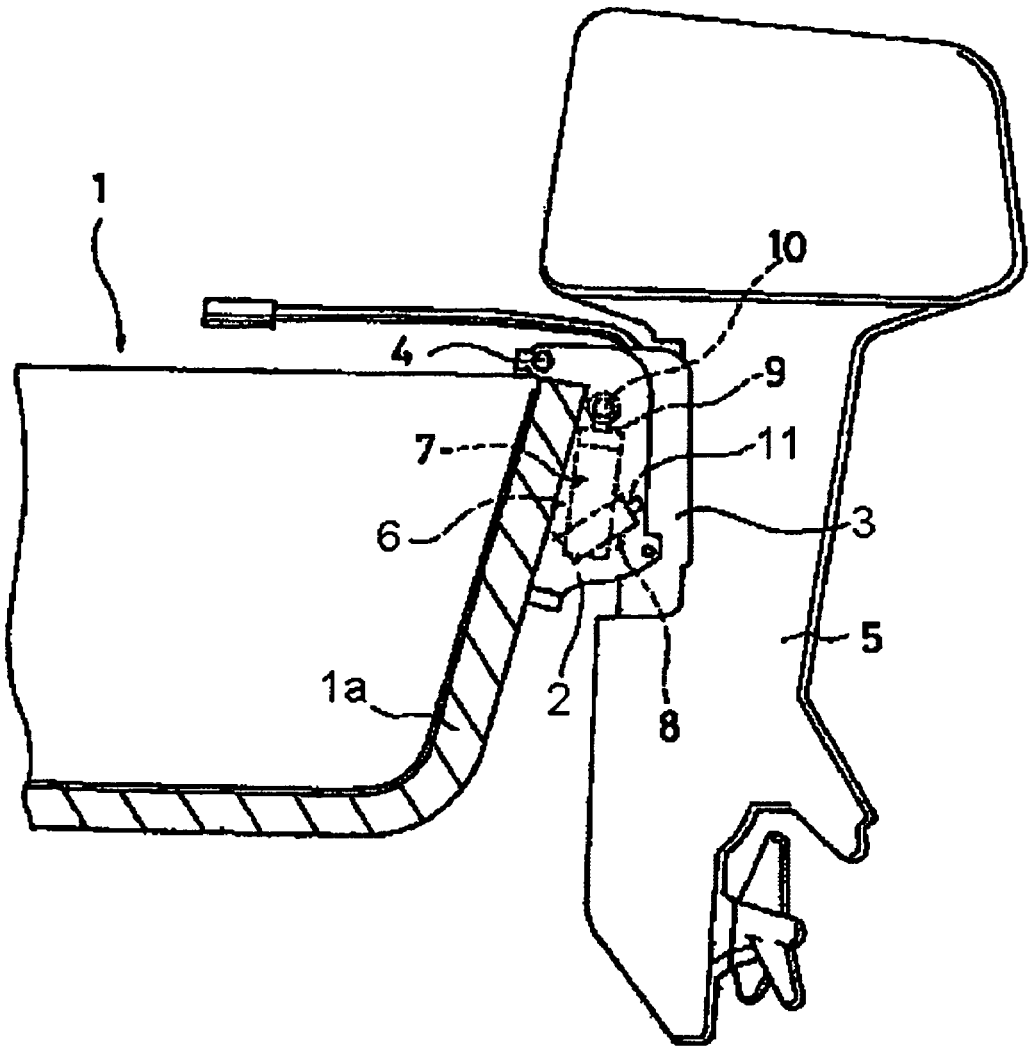
FIG. 1 shows an external appearance of an outboard motor including a tilt and trim device according to a preferred embodiment of the present invention.
Figure 2:
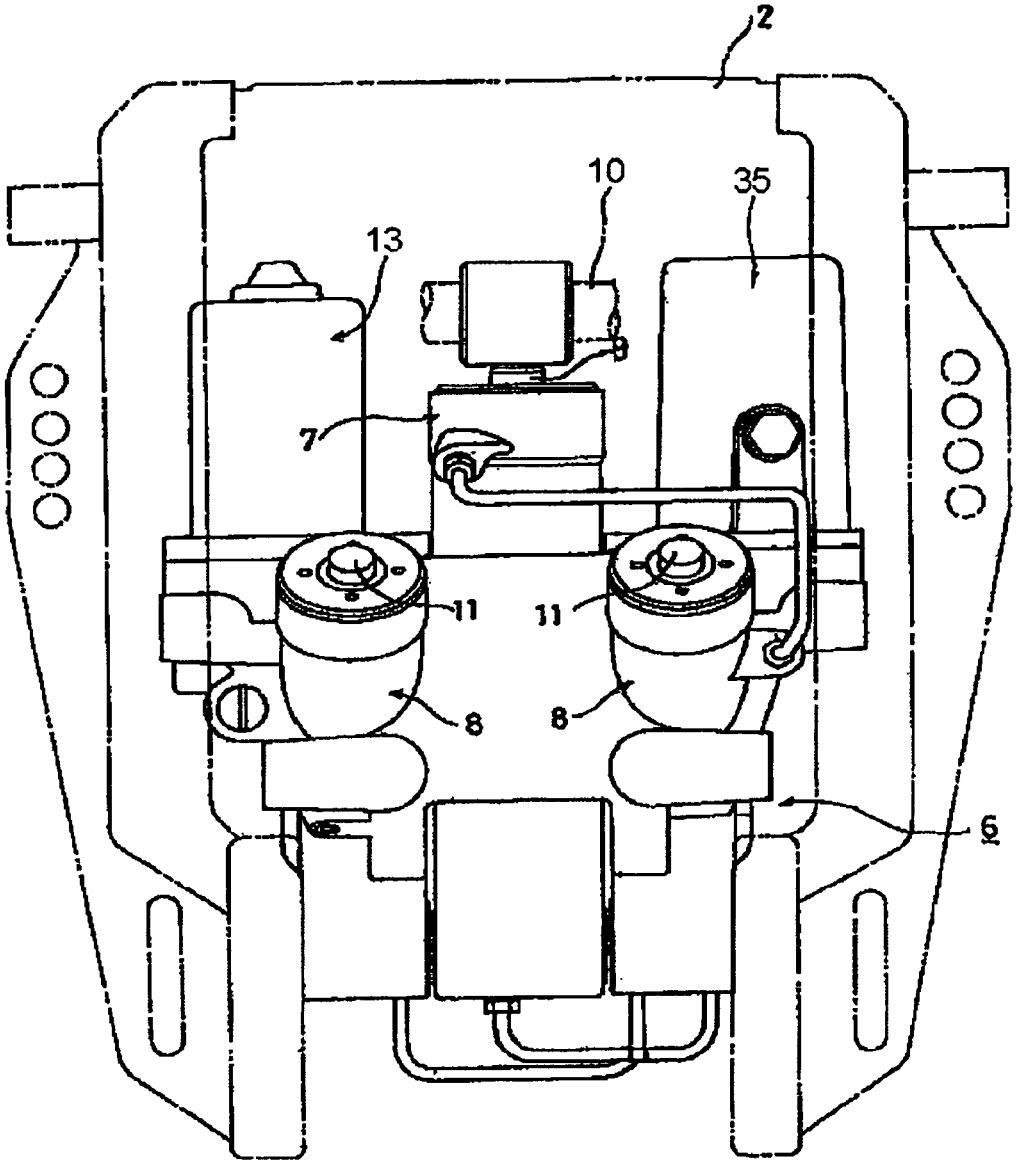
FIG. 2 is a front view of the tilt and trim device for the outboard motor to which a preferred embodiment of the present invention is applied.

FIG. 1 shows an external appearance of an outboard motor including a tilt and trim device according to a preferred embodiment of the present invention, and FIG. 2 is a front view of the tilt and trim device.

A clamp bracket 2 is fixed on a stern plate 1*a* of a hull 1. A tilt bracket 3 is supported by the clamp bracket 2 to pivot about a horizontal shaft 4. An outboard motor 5 is supported by the tilt bracket 3 to rotate about a swivel shaft (not shown) that is substantially perpendicular to the horizontal shaft 4.

A tilt and trim device 6 is mounted on the clamp bracket 2. A tilt cylinder 7 including a hydraulic mechanism is provided on a middle portion of the tilt and trim device 6, and a trim cylinder 8 is provided on each lateral side of the tilt cylinder 7. A rod 9 of the tilt cylinder 7 is connected to the tilt bracket 3 via a clamp shaft 10. Expansion and contraction of the rod 9 allows the raising and lowering operation (tilt up/down) of the outboard motor 5 in a tilt range.

A rod 11 of the trim cylinder 8 contacts the tilt bracket 3 (hereinafter, references to the structure and operation of a trim cylinder 8 applies to both trim cylinders 8). Expansion and contraction of the rod 11 allows the raising and lowering operation (trim up/down) of the outboard motor 5 in a trim range that is narrower than the tilt range. A motor 13 that drives a hydraulic pump described below is disposed on one side of the tilt cylinder 7, and an oil tank 35 is disposed on the other side of the tilt cylinder 7.

Figure 3:
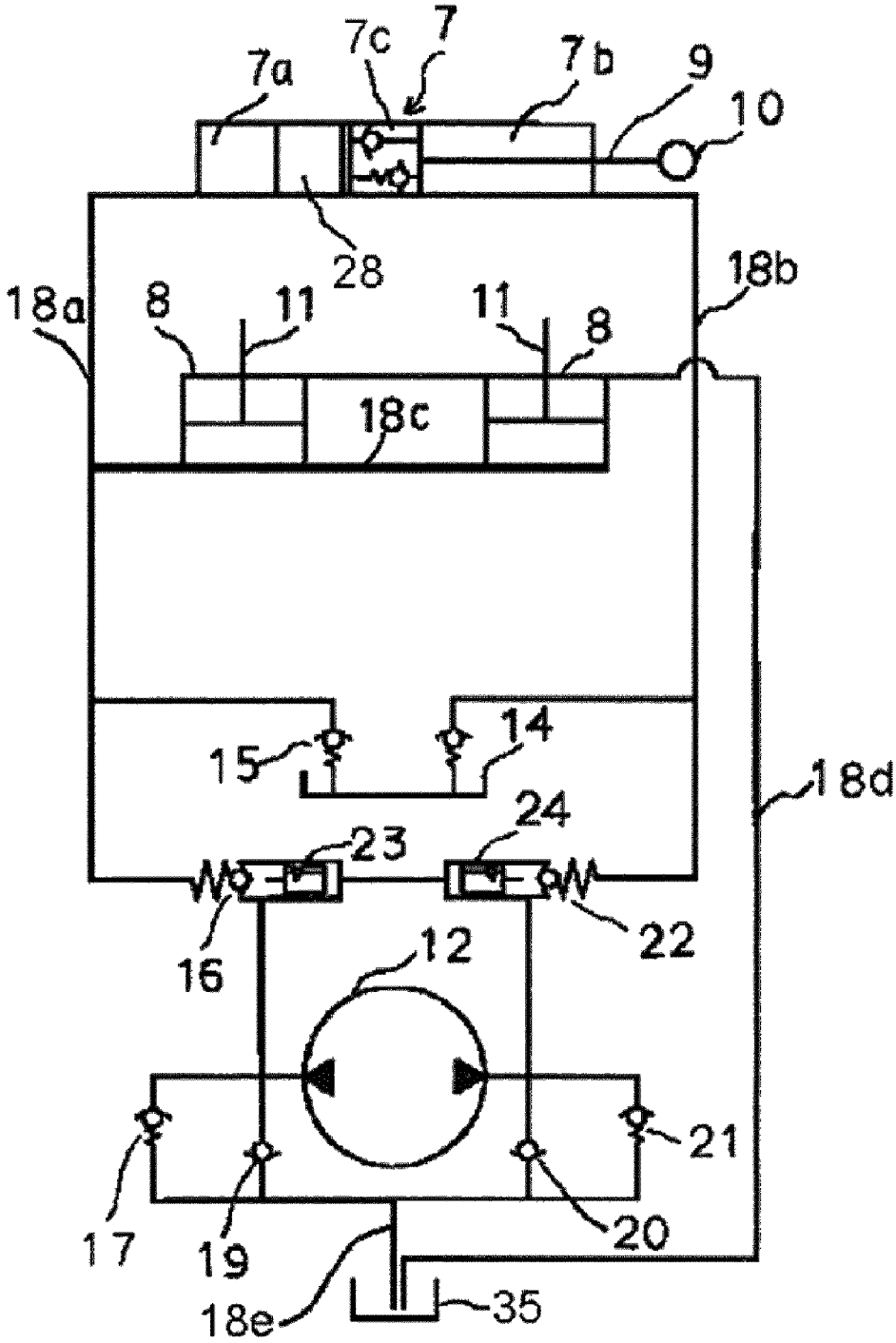
FIG. 3 is a hydraulic circuit diagram of the tilt and trim device shown in the figures.

FIG. 3 shows a hydraulic circuit diagram of the tilt and trim device.

A hydraulic pump 12 is driven by the motor 13 (FIG. 2). The motor 13 is preferably a reversible DC motor, and the hydraulic pump 12 reversibly rotates in the normal or opposite direction by operation of the motor 13. A main valve 16 is provided on the outlet side of the hydraulic pump 12. The main valve 16 communicates with an oil route 18*a* which brings the tilt cylinder 7 into communication with a reserve tank 14. Oil is pumped to a tilt cylinder extension side oil chamber 7*a* of the tilt cylinder 7 (i.e., the chamber not containing the rod 9) via the oil route 18*a*. This allows the rod 9 to be pushed up, and the tilt up operation is executed. The reference numeral 28 denotes a free piston. At this time, oil in a tilt cylinder rod housing oil chamber 7*b* of the tilt cylinder 7 is discharged, passes through a hydraulic route 18*b* and a main valve 22, and returns to the hydraulic pump 12. The main valve 22 is opened by the operation of shuttle valves 23 and 24 located, respectively, in the main valves 16 and 22 that are operated by the hydraulic pressure on the outlet side.

A branch oil route 18*c* is provided in the middle of the oil route 18*a* to communicate therewith. The oil is pumped from the branch oil route 18*c* to the trim cylinder 8, and the trim operation is executed via the rods 11. The reference numeral 18*d* denotes a return side hydraulic route from the trim cylinder 8.

A manual valve 15 with which the tilt operation can be executed manually is provided slightly in front of the reserve tank 14 in the oil route 18*a*. The reserve tank 14 communicates with the oil tank 35.

An up relief valve 17, a down relief valve 21, and one-way valves 19 and 20 are provided on the outlet side of the hydraulic pump 12. The up relief valve 17 and the down relief valve 21 respectively return oil to the oil tank 35 when the hydraulic pressure in the tilt cylinder 7 becomes equal to or higher than a specified pressure value in accordance with the amount of oil in the tilt cylinder extension side oil chamber 7*a* or that in the tilt cylinder rod housing oil chamber 7*b* in the tilt cylinder 7 during the tilt operation. The one-way valves 19 and 20 supply the oil to the outlet side from the oil tank 35 via a suction side hydraulic route 18*e* when the amount of oil in the tilt cylinder extension side oil chamber 7*a* or the tilt cylinder rod housing oil chamber 7*b* becomes insufficient during the tilt operation.

The above-described manual valve 15, the main valves 16 and 22, the up relief valve 17, the down relief valve 21, and the one-way valves 19 and 20 are preferably integrally incorporated with the hydraulic pump 12.

When the boat travels in shallow water, that is, travels in a tilt up state, the hydraulic pressure is applied to the tilt cylinder extension side oil chamber 7*a*, and the piston 7*c* in the tilt cylinder 7 is pressed against the rod 9 toward the tilt cylinder rod housing oil chamber 7*b*. After passing through the shallow water, when the accelerator is fully opened in a state that the rear end of the boat is gradually tilted down, the propeller churns the water, and the boat rapidly receives the reaction force of the thrust. Consequently, the piston 7*c* in the tilt cylinder 7 attempts to rapidly move to the tilt cylinder extension side oil chamber 7*a*. At this time, the high hydraulic pressure is applied to the oil route 18*a*, and the manual valve 15 is opened to release the oil to the reserve tank 14. At the same time, the oil flows in the trim cylinder 8 passing through the branch oil route 18*c*, so that the above-described problem of the rapid increase in the hydraulic pressure occurs.

First Preferred Embodiment

Figure 4:
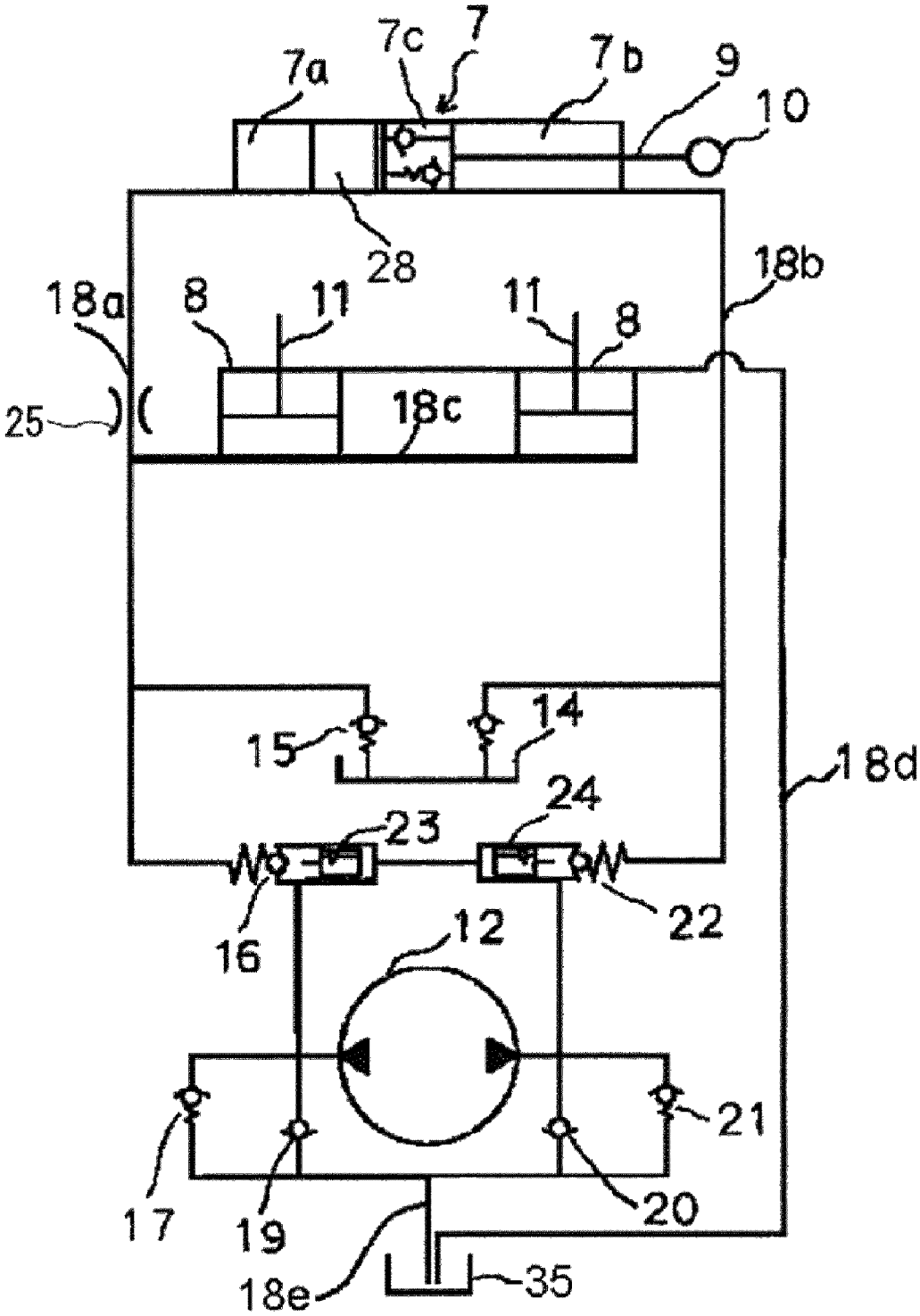
FIG. 4 is a hydraulic circuit diagram including a hydraulic pressure adjustment mechanism used in the tilt and trim device for the outboard motor according to a preferred embodiment of the present invention.
Figure 5:
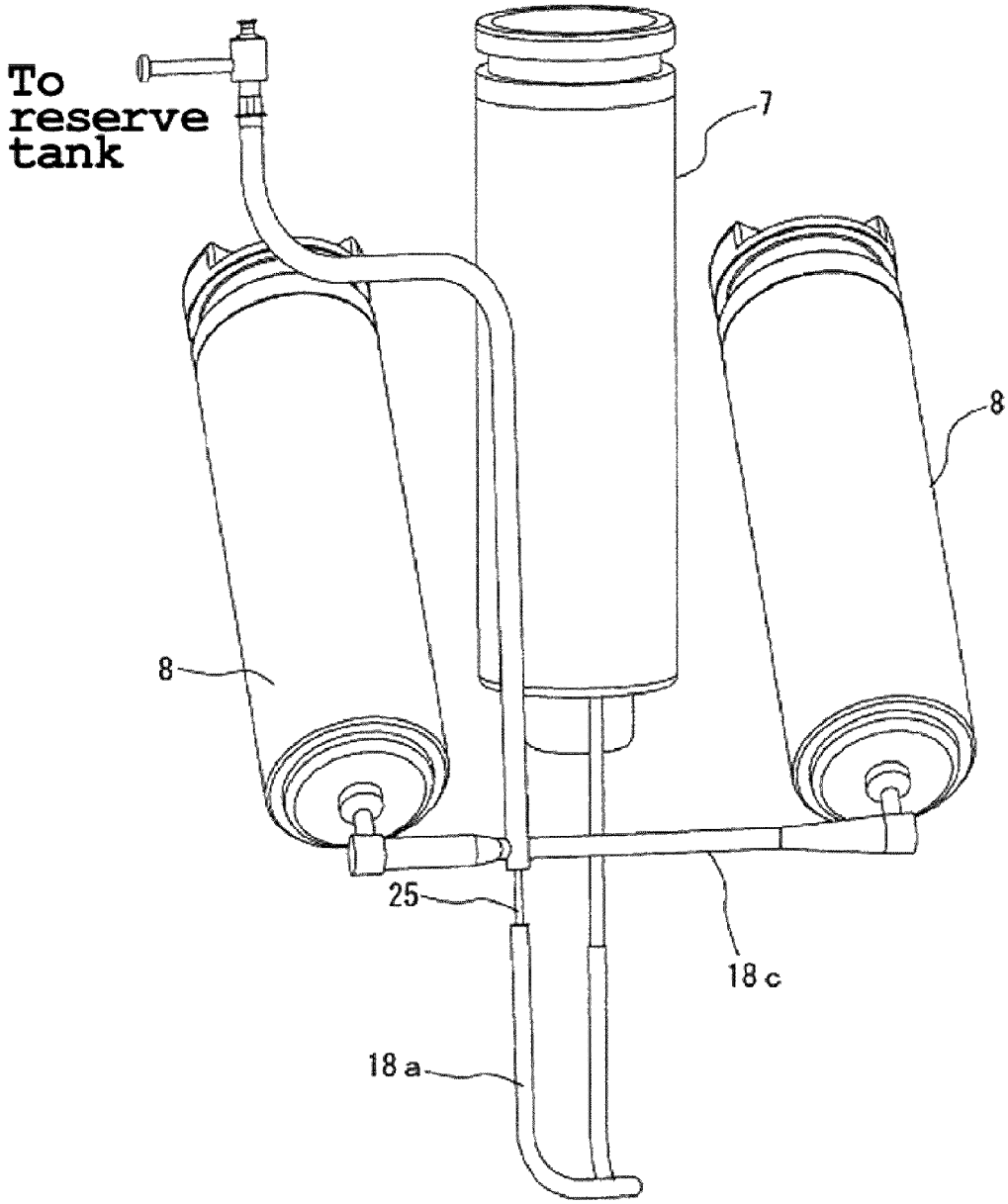
FIG. 5 is a schematic diagram of an oil route including the hydraulic pressure adjustment mechanism shown in FIG. 4.
Figure 6:
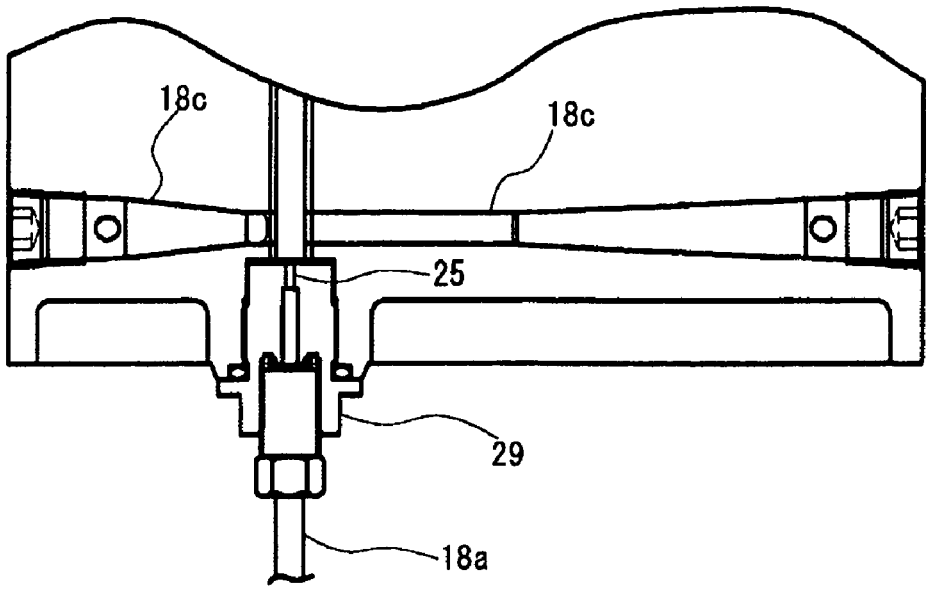
FIG. 6 is a schematic cross-sectional view of the hydraulic pressure adjustment mechanism shown in FIG. 4.

FIG. 4 shows a hydraulic circuit diagram including a hydraulic pressure adjustment mechanism used in the tilt and trim device for the outboard motor according to a preferred embodiment of the present invention. FIG. 5 is a schematic diagram of an oil route including the hydraulic pressure adjustment mechanism. FIG. 6 is a schematic cross-sectional view of the hydraulic pressure adjustment mechanism.

As shown in FIG. 4, the hydraulic pressure adjustment mechanism shown in this preferred embodiment includes an orifice portion 25 provided on the oil route 18*a*. This prevents the oil from flowing toward the trim cylinder 8 and prevents the excessive hydraulic pressure from being applied to the trim cylinder 8. As shown in FIGS. 5 and 6, the orifice portion 25 is provided in the oil route 18*a*. The inner diameter of the orifice portion 25 is equal to or smaller than the inner diameter of the oil route 18*a* (preferably, equal to or smaller than about half of the inner diameter). It is confirmed that this configuration prevents excessive hydraulic pressure from being applied to the trim cylinder 8. In such a case, the oil passes through the orifice portion 25 during the normal tilt up/down operation by the hydraulic pump 12. However, when the inner diameter of the orifice portion 25 is about half of the inner diameter of the oil route (for example, when the oil route has approximately a 3 mm diameter, the orifice portion has approximately a 1.5 mm diameter), the oil flow in the normal raising or lowering operation of the outboard motor by the hydraulic pump 12 is not influenced even if the orifice portion 25 is provided in the oil route 18*a* (see FIG. 5).

As shown in FIG. 6, when the orifice portion 25 is provided in the oil route 18*a* in front of the branch oil route 18*c*, the orifice portion 25 is formed by reducing the diameter of a hole that passes through a connecting member (collar) 29 which is a joint member of the oil route 18*a*. The tilt and trim device of this preferred embodiment may be applied to a currently used tilt and trim device of the outboard motor only by replacing the connecting member 29. As a result, the deformation of and damage to the trim cylinder 8 can be prevented with a quick and easy method.

Second Preferred Embodiment

Figure 7:
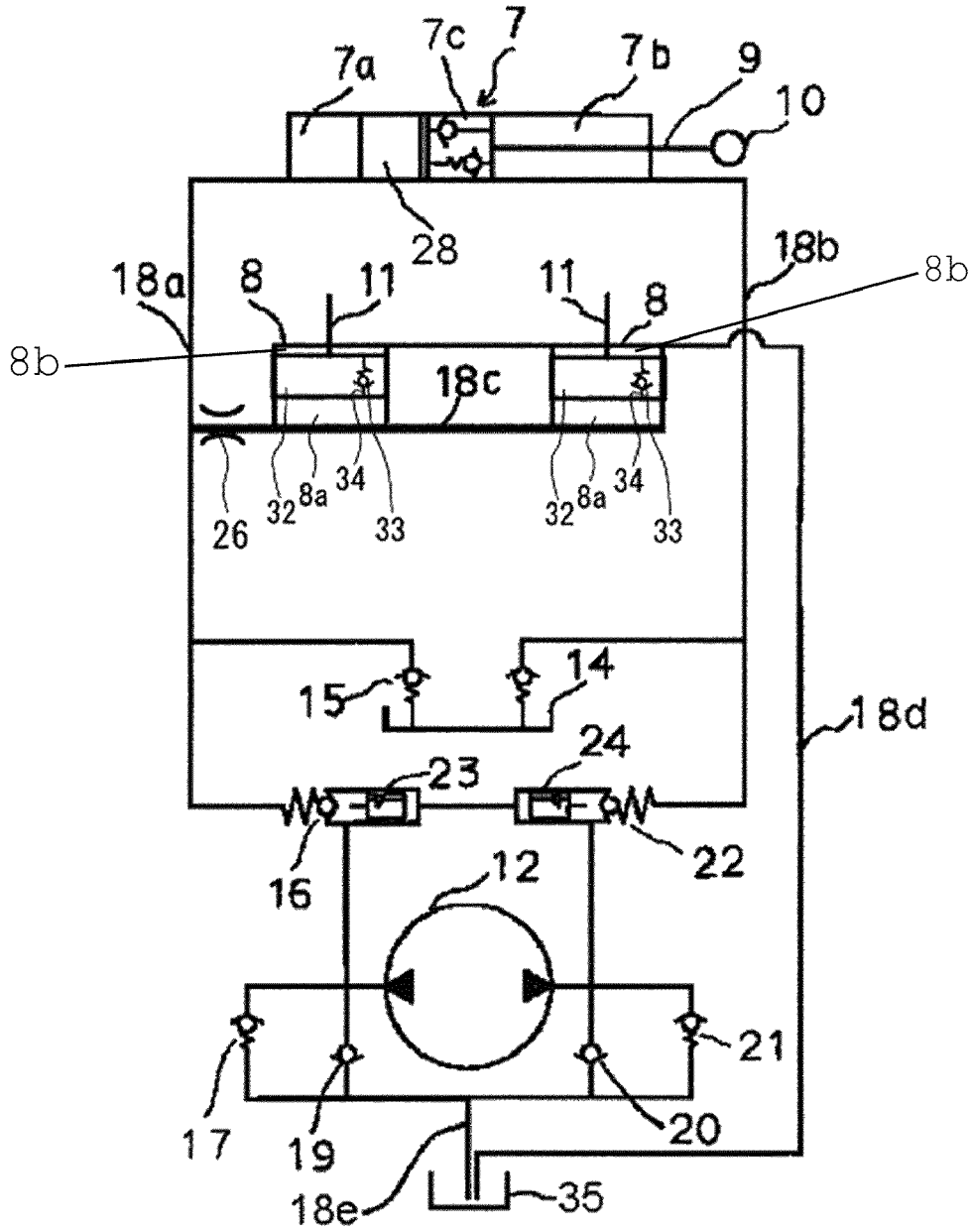
FIG. 7 is a hydraulic circuit diagram including a hydraulic pressure adjustment mechanism used in another tilt and trim device for an outboard motor according to a preferred embodiment of the present invention.
Figure 8:
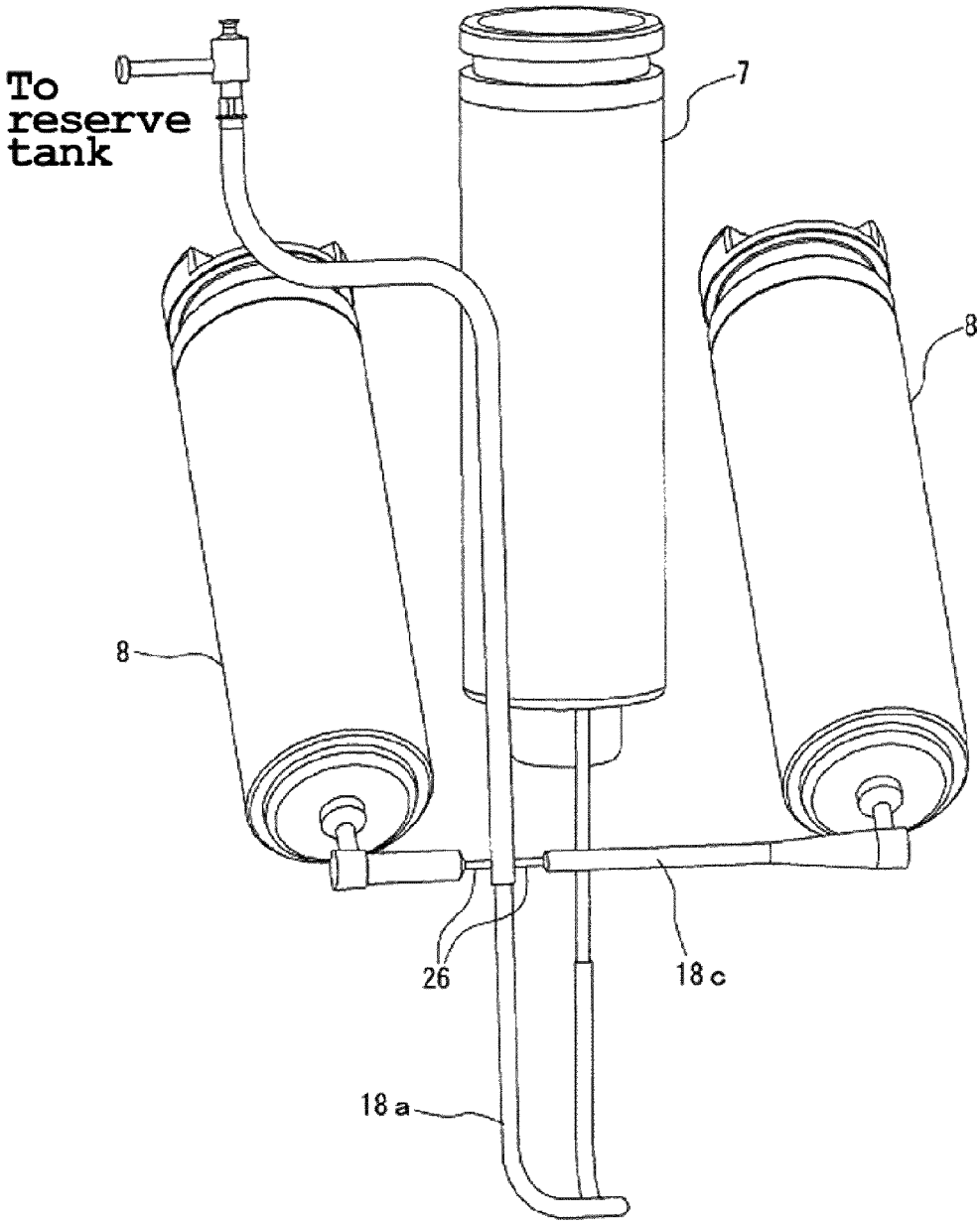
FIG. 8 is a schematic diagram of an oil route including the hydraulic pressure adjustment mechanism shown in FIG. 7.
Figure 9:
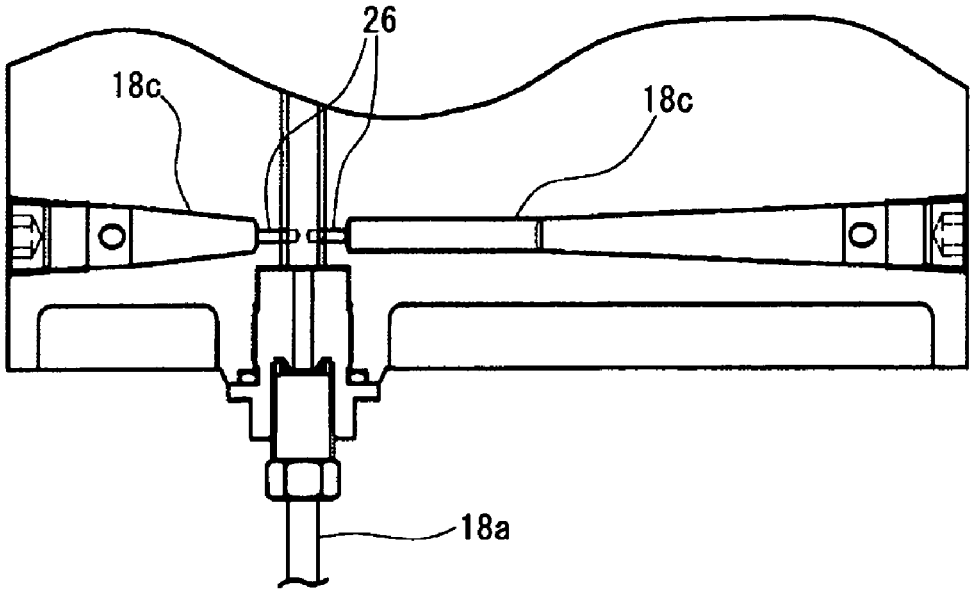
FIG. 9 is a schematic cross-sectional view of the hydraulic pressure adjustment mechanism shown in FIG. 7.
Figure 10:
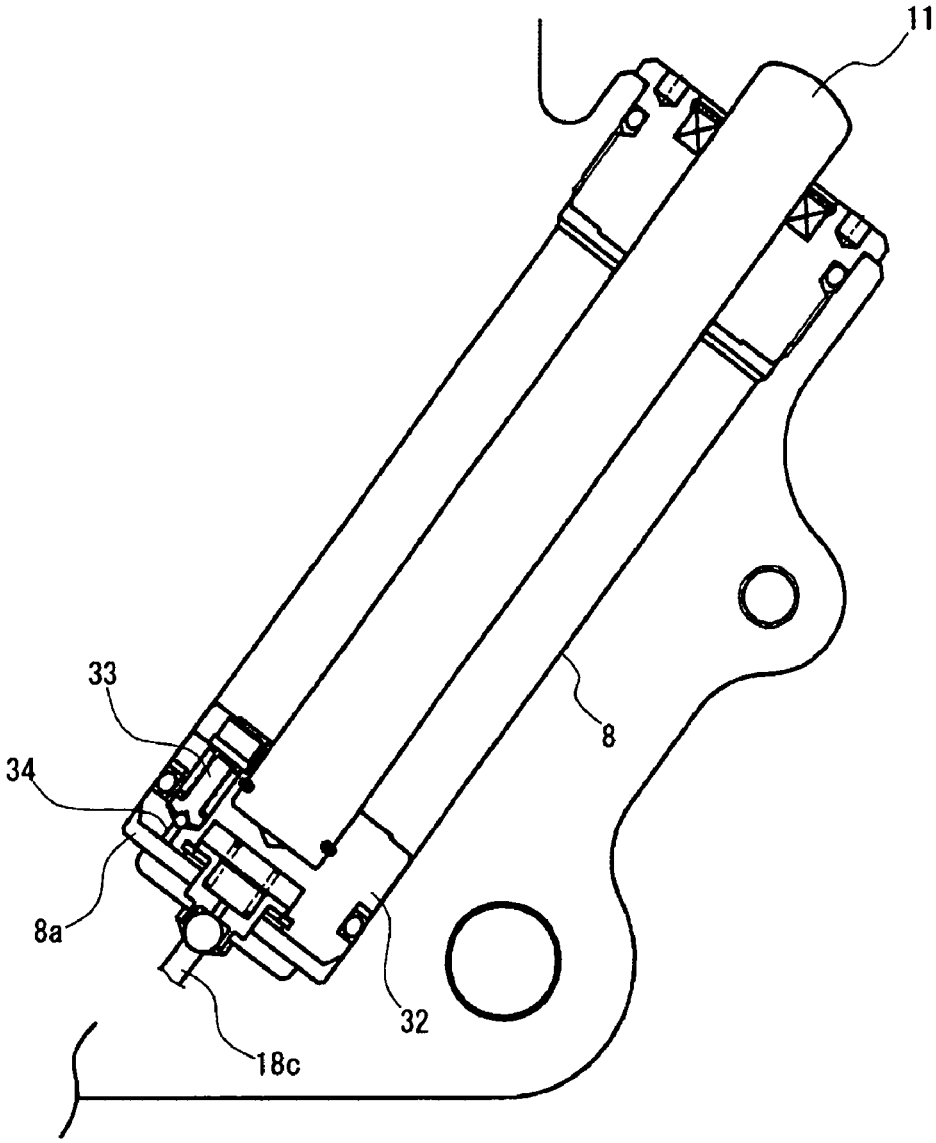
FIG. 10 is a schematic cross-sectional view of the trim cylinder when the hydraulic pressure adjustment mechanism of FIG. 7 is used.

FIG. 7 shows a hydraulic circuit diagram including a hydraulic pressure adjustment mechanism used in another tilt and trim device for an outboard motor according to a preferred embodiment of the present invention. FIG. 8 is a schematic diagram of an oil route including the hydraulic pressure adjustment mechanism. FIG. 9 is a schematic cross-sectional view of the hydraulic pressure adjustment mechanism. FIG. 10 is a schematic cross-sectional view of the trim cylinder when the hydraulic pressure adjustment mechanism is used.

As shown in FIG. 7, the hydraulic pressure adjustment mechanism shown in this preferred embodiment includes the orifice portion 26 provided in the branch oil route 18*c*. This prevents the oil from flowing toward the trim cylinder 8 and prevents the excessive hydraulic pressure from being applied to the trim cylinder 8. As shown in FIGS. 8 and 9, the orifice portion 26 is provided in a portion of the branch oil route 18*c* branched from the oil route 18*a*. The inner diameter of the orifice portion 26 is equal to or smaller than the inner diameter of the oil route 18*a* (preferably, equal to or smaller than about half of the inner diameter). It is confirmed that this configuration prevents excessive hydraulic pressure from being applied to the trim cylinder 8. Moreover, by providing the orifice portion 26 in the branch oil route 18*c*, the hydraulic pressure applied to the trim cylinder 8 can be reduced without influencing the oil flow via the oil route 18*a* in the normal raising or lowering operation of the outboard motor by the hydraulic pump 12.

Moreover, when the orifice portion 26 is provided in the branch oil route 18*c*, the following configuration is preferably added.

A through hole 34 penetrating in the sliding direction of a piston 32 is provided in the piston 32 in the trim cylinder 8. In the through hole 34, a one-way relief valve 33 into which the oil can flow from the trim cylinder extension side oil chamber 8*a* of the trim cylinder 8 to the trim cylinder rod housing oil chamber 8*b* of the trim cylinder 8 is provided. Therefore, even when the outboard motor is rapidly lowered from the tilt range, and the high hydraulic pressure that is equal to or higher than withstand pressure value of the trim cylinder 8 is applied to the trim cylinder 8, the one-way relief valve 33 provided in the through hole 34 is opened to release the hydraulic pressure to the trim cylinder rod housing oil chamber 8*b* of the trim cylinder 8. This reduces the hydraulic pressure applied to the trim cylinder 8, and prevents deformation of and damage to the trim cylinder 8 that can be caused by excessive hydraulic pressure. By applying this configuration in addition to the above hydraulic pressure adjustment mechanism (orifice portion 26), the influence of the hydraulic pressure on the trim cylinder 8 can be reduced. Additionally, even when this configuration is used without the hydraulic pressure adjustment mechanism, the influence of the hydraulic pressure on the trim cylinder 8 can be sufficiently reduced.

Figure 11:
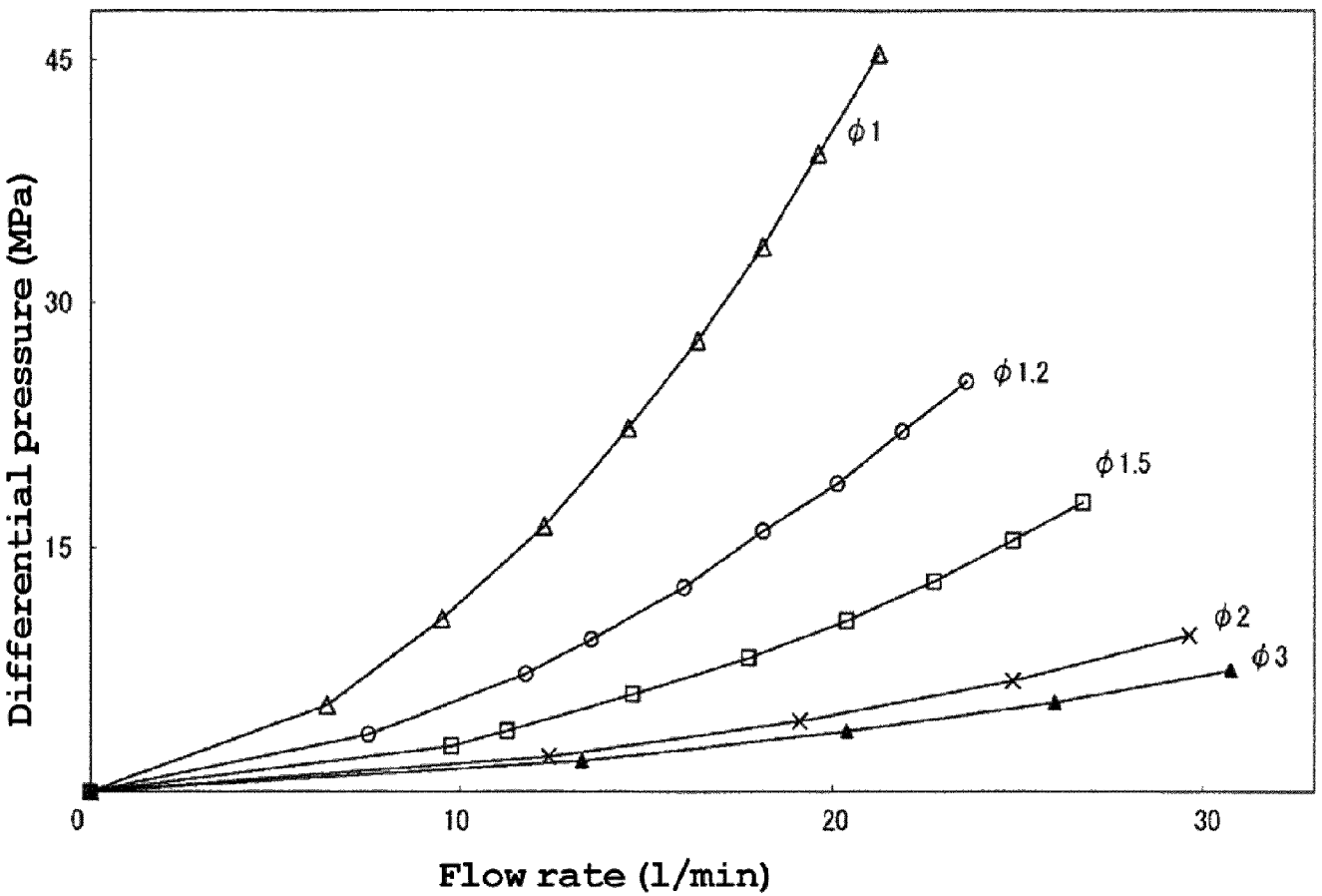
FIG. 11 is a graph showing the relationship between the pressure drop (MPa) before and after passing through a orifice portion and a flow rate (1/min) when the inner diameter of the orifice portion is changed.

FIG. 11 is a graph showing the relationship between the pressure drop (MPa) before and after passing through the orifice portion and the flow rate (1/min) when the inner diameter of the orifice portion is changed.

As shown in the graph, the smaller the diameter of the orifice portion becomes, the larger the differential pressure in a uniform flow rate becomes. That is, when the diameter of the orifice portion is reduced, the influence of the hydraulic pressure on the trim cylinder can be reduced. However, when the diameter of the orifice portion is too small, the differential pressure becomes too large, so that the oil is prevented from smoothly flowing into the trim cylinder 8. The amount of oil flow when the tilt cylinder 7 is rapidly lowered is about 21 (1/min) to about 28 (1/min), for example. The differential pressure is preferably about 15 (MPa), for example. Therefore, most preferably, the orifice portion has approximately a 1.5 mm diameter, for example. In general, as the inner diameter of the oil route 18*a* has approximately a 3 mm diameter, it can be said that the inner diameter of the orifice portion is preferably about half or not greater than about half of the inner diameter of the oil route 18*a*.

Third Preferred Embodiment

Figure 12:
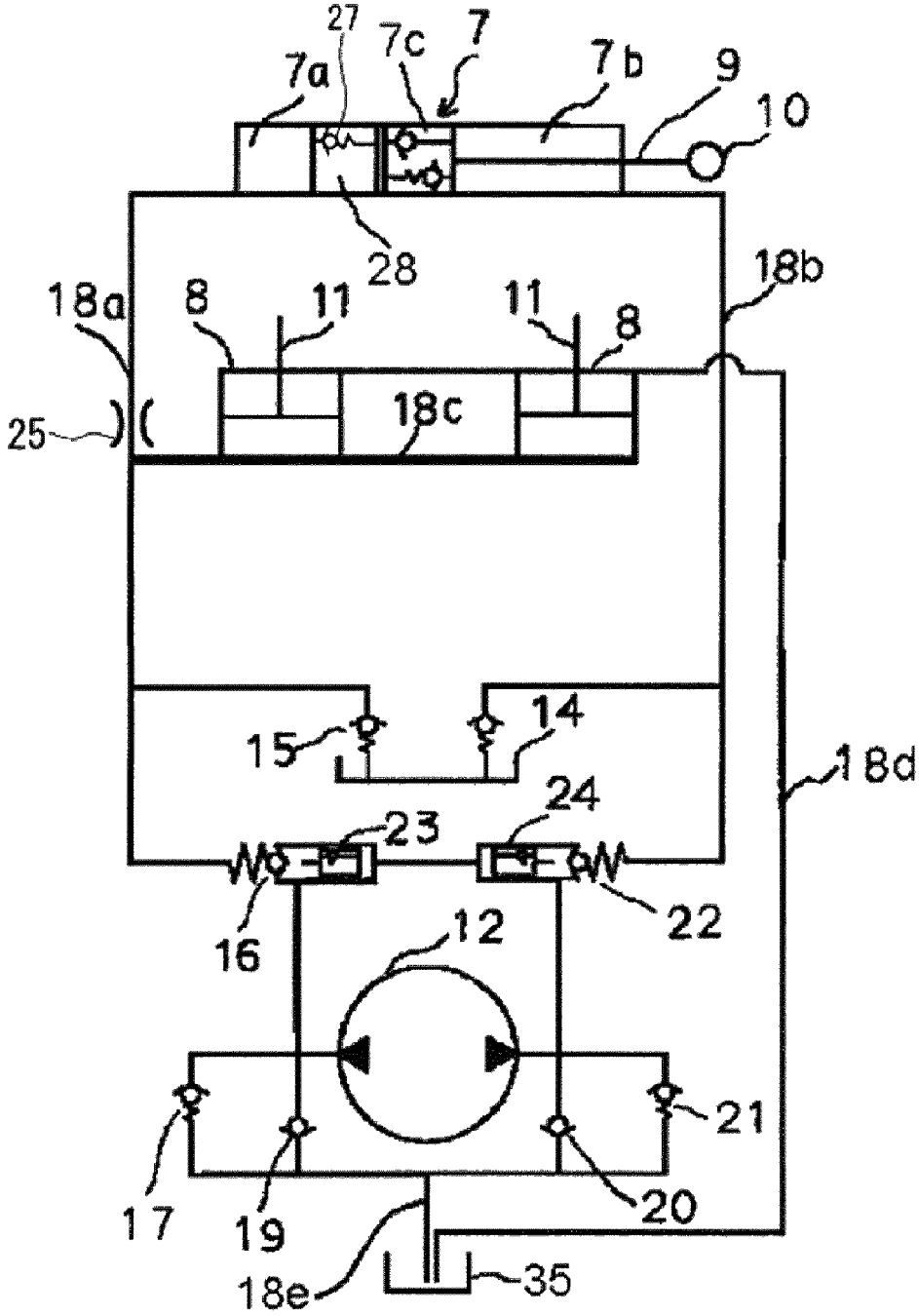
FIG. 12 shows a hydraulic circuit diagram with which the hydraulic pressure adjustment mechanism used in the tilt and trim device for the outboard motor according to a preferred embodiment of the present invention is preferably used.
Figure 13:
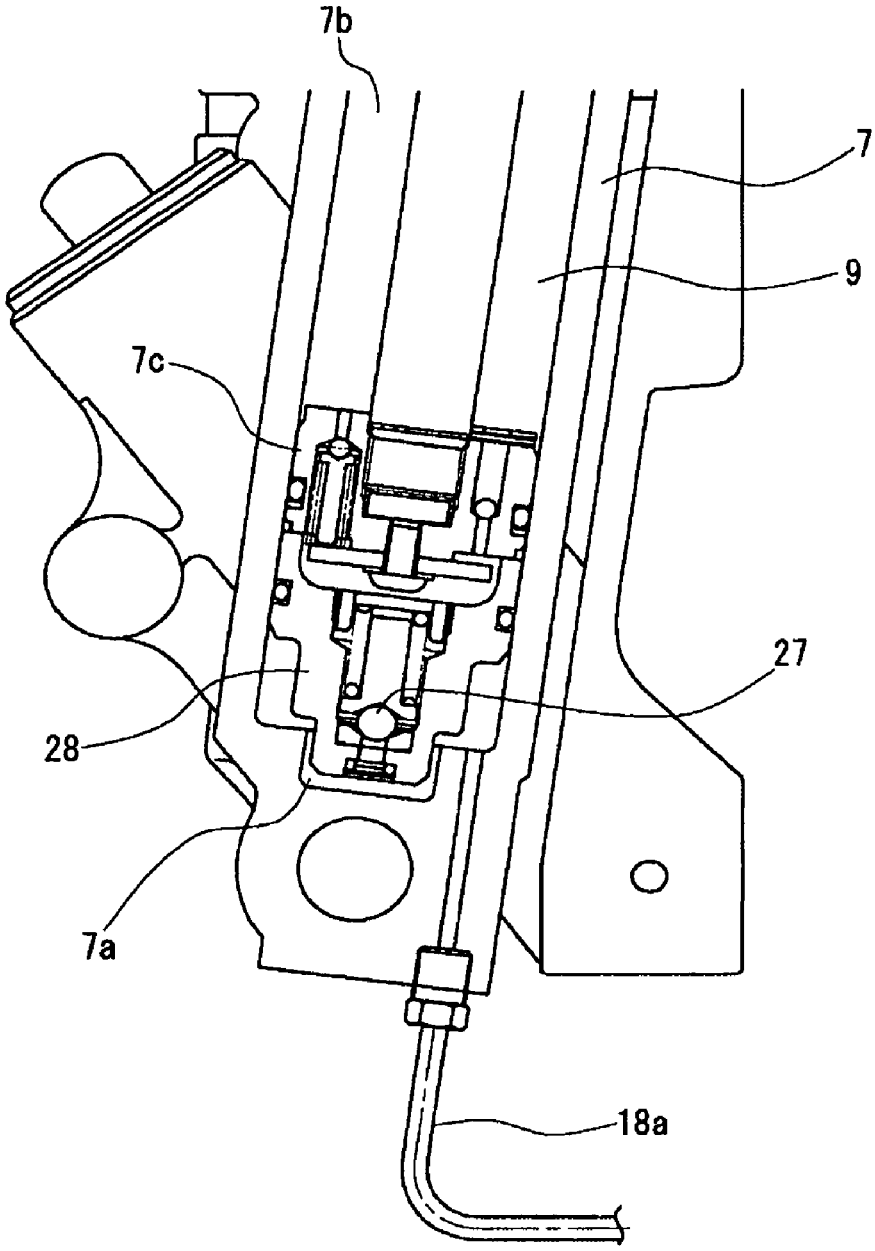
FIG. 13 is a schematic cross-sectional view of the tilt cylinder shown in FIG. 12.

FIG. 12 shows a hydraulic circuit diagram in which the hydraulic pressure adjustment mechanism used in the tilt and trim device for the outboard motor according to a preferred embodiment of the present invention is preferably used. FIG. 13 is a schematic cross-sectional view of the tilt cylinder shown in FIG. 12.

As shown in FIG. 12, the free piston 28 is provided in the tilt cylinder extension side oil chamber 7*a* of the tilt cylinder 7. A one-way relief valve 27 is provided in the free piston 28 so that the oil flows from the tilt cylinder extension side oil chamber 7*a* to the tilt cylinder rod housing oil chamber 7*b*. Due to this configuration, when the outboard motor is rapidly lowered from the tilt range and the oil in the tilt cylinder 7 rapidly flows into the oil route 18*a*, the hydraulic pressure is applied to the free piston 28. Consequently, the one-way relief valve 27 is opened to release the hydraulic pressure in the rod direction of the tilt cylinder 7 (in the direction of the tilt cylinder rod housing oil chamber 7*b*). This reduces the hydraulic pressure applied to the trim cylinder 8 via the oil route 18*a*, and prevents deformation of and damage to the trim cylinder 8 that can be caused by the excessive hydraulic pressure. By using this configuration in addition to the above hydraulic pressure adjustment mechanism, the influence of the hydraulic pressure to the trim cylinder 8 can be further reduced. Additionally, even when this configuration is used without the hydraulic pressure adjustment mechanism, the influence of the hydraulic pressure on the trim cylinder 8 can be sufficiently reduced.

By utilizing this configuration with the orifice portion 25, the pressure applied to the trim cylinder 8 can be reduced more effectively. In particular, this configuration is utilized effectively with the orifice portion 25 when an aperture of the orifice portion 25 is not smaller than about half of the inner diameter of the oil route 18*a* or when it is difficult to reduce the high pressure from the tilt cylinder extension side oil chamber 7*a* only by the orifice portion 25 and the like.

Fourth Preferred Embodiment

Figure 14:
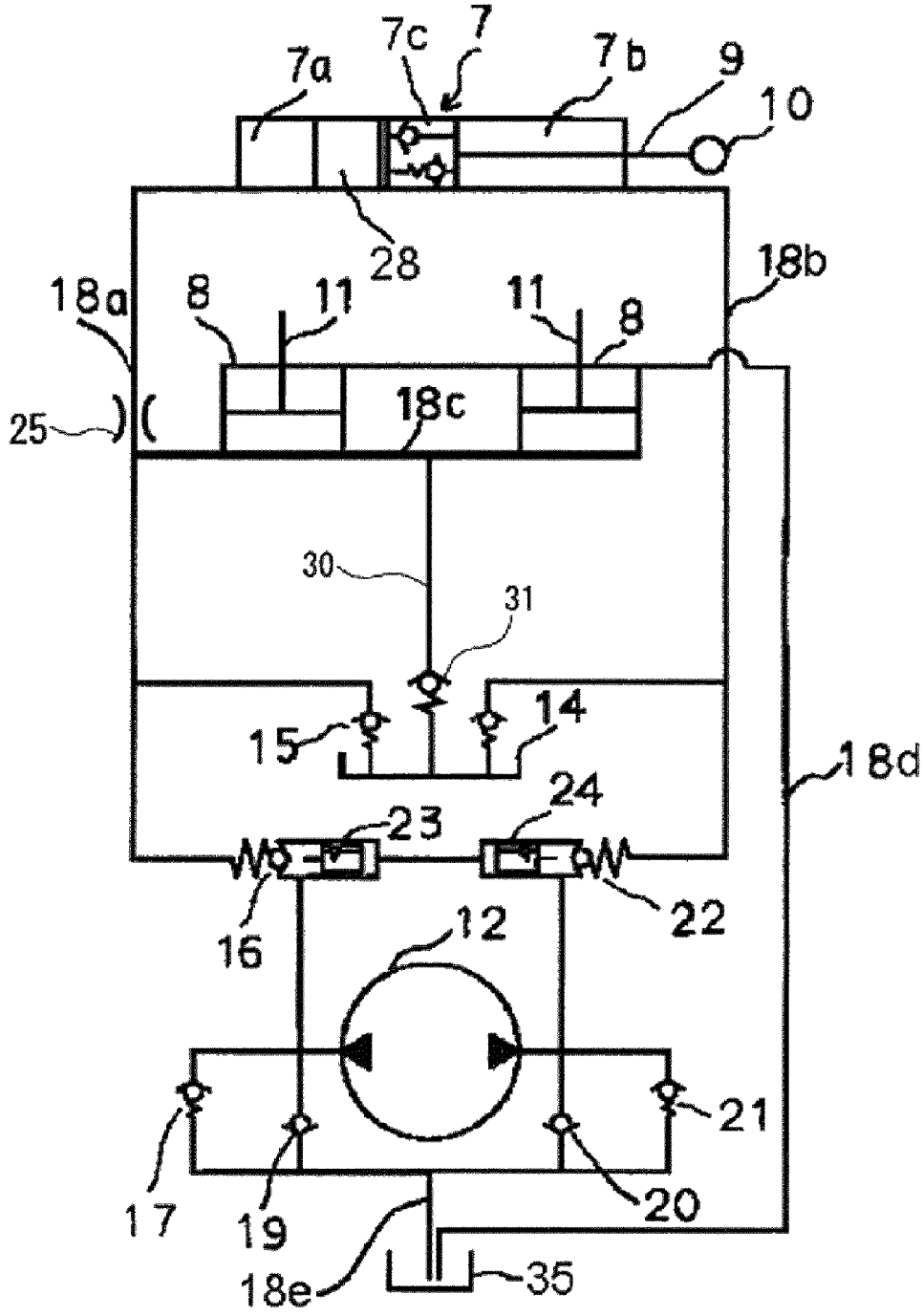
FIG. 14 shows a hydraulic circuit diagram with which the hydraulic pressure adjustment mechanism used in the tilt and trim device for the outboard motor according to a preferred embodiment of the present invention is preferably used.

FIG. 14 shows a hydraulic circuit diagram in which the hydraulic pressure adjustment mechanism used in the tilt and trim device for the outboard motor according to a preferred embodiment of the present invention is preferably used.

As shown in the drawing, the branch oil route 18*c* is further branched to define a bypass route 30. The bypass route 30 communicates with the reserve tank 14. A one-way relief valve 31 that allows the oil to flow toward the reserve tank 14 is provided in the bypass route 30. Due to this configuration, even when the outboard motor is rapidly lowered from the tilt range, and the high hydraulic pressure that is equal to or higher than the withstand pressure value of the trim cylinder 8 is applied to the trim cylinder 8 via the branch oil route 18*c*, the one-way relief valve 31 provided in the bypass route 30 is opened to release the hydraulic pressure to the reserve tank 14. This reduces the hydraulic pressure applied to the trim cylinder 8, and prevents deformation of and damage to the trim cylinder 8 that can be caused by the excessive hydraulic pressure. By using this configuration in addition to the above hydraulic pressure adjustment mechanism, the influence of the hydraulic pressure on the trim cylinder 8 can be further reduced. Additionally, even when this configuration is used without the hydraulic pressure adjustment mechanism, the influence of the hydraulic pressure to the trim cylinder 8 can be sufficiently reduced.

By utilizing this configuration with the orifice portion 25, the pressure applied to the trim cylinder 8 can be reduced more effectively. In particular, this configuration is utilized effectively with the orifice portion 25 when an aperture of the orifice portion 25 is not smaller than about half of the inner diameter of the oil route 18*a* or when it is difficult to reduce the high pressure from the tilt cylinder extension side oil chamber 7*a* only by the orifice portion 25 and the like.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A tilt and trim device for an outboard motor, the tilt and trim device comprising:

a tilt cylinder to raise and lower the outboard motor;

a trim cylinder to raise and lower the outboard motor;

a tilt cylinder extension side oil chamber and a tilt cylinder rod housing oil chamber provided in the tilt cylinder;

a trim cylinder extension side oil chamber and a trim cylinder rod housing oil chamber provided in the trim cylinder;

a reserve tank to receive a difference of an oil amount between an oil amount in the tilt cylinder extension side oil chamber and an oil amount in the tilt cylinder rod housing oil chamber and between an oil amount in the trim cylinder extension side oil chamber and an oil amount in the trim cylinder rod housing oil chamber when the outboard motor is operated;

a relief valve to communicate with the reserve tank;

an oil route to allow the tilt cylinder extension side oil chamber to communicate with the reserve tank; and a branch oil route branched from the oil route and to communicate with the trim cylinder; wherein at least one hydraulic pressure adjustment mechanism is arranged between the tilt cylinder extension side oil chamber and the trim cylinder extension side oil chamber to adjust hydraulic pressure applied to the trim cylinder from the branch oil route to be not greater than a specified value when the outboard motor is forcibly lowered by an external force from a tilt range in which the outboard motor is raised or lowered only by the tilt cylinder.

2. The tilt and trim device for an outboard motor according to claim 1, wherein the hydraulic pressure adjustment mechanism includes an orifice portion in the oil route or the branch oil route that allows the tilt cylinder extension side oil chamber to communicate with the trim cylinder extension side oil chamber.

3. The tilt and trim device for an outboard motor according to claim 2, wherein an inner diameter of the orifice portion is not greater than an inner diameter of the oil route.

4. The tilt and trim device for an outboard motor according to claim 1, further comprising a through hole penetrating a piston in the trim cylinder in the sliding direction of the piston, and a one-way relief valve provided in the through hole to allow oil to flow from the trim cylinder extension side oil chamber.

5. The tilt and trim device for an outboard motor according to claim 1, further comprising a free piston provided in the tilt cylinder, and a one-way relief valve provided in the free piston to allow oil to flow from the tilt cylinder extension side oil chamber.

6. The tilt and trim device for an outboard motor according to claim 1, further comprising a bypass route to connect the branch oil route and the reserve tank, and a one-way relief valve to allow oil to flow in a direction of the reserve tank of the bypass route.

* * * * *